US008732919B1

(12) United States Patent
Malueg-Ray

(10) Patent No.: US 8,732,919 B1
(45) Date of Patent: May 27, 2014

(54) UNDERWATER, PET ASHES MEMORIAL DISPLAY AND MARINE REFUGE

(76) Inventor: Terri L. Malueg-Ray, Jacksonville, FL (US)

( * ) Notice: Subject to any disclaimer, the term of this patent is extended or adjusted under 35 U.S.C. 154(b) by 0 days.

(21) Appl. No.: 13/385,447

(22) Filed: Feb. 21, 2012

Related U.S. Application Data

(60) Provisional application No. 61/444,991, filed on Feb. 21, 2011.

(51) Int. Cl.
*A61G 17/00* (2006.01)

(52) U.S. Cl.
USPC ..... 27/1; 405/210

(58) Field of Classification Search
USPC ..... 27/1, 35; 40/124.5; 211/85.27; 405/25, 405/210; 52/128, 133, 134, 136; 119/221
See application file for complete search history.

(56) References Cited

U.S. PATENT DOCUMENTS

| | | | | |
|---|---|---|---|---|
| 3,561,402 | A | 2/1971 | Ishida et al. | 119/3 |
| 3,732,602 | A | 5/1973 | Vigh | 27/1 |
| 4,227,325 | A * | 10/1980 | Whitford | 40/124.5 |
| 5,564,369 | A | 10/1996 | Barber et al. | 119/221 |
| 5,729,921 | A * | 3/1998 | Rojas | 40/124.5 |
| 6,189,188 | B1 | 2/2001 | O'Hare | 27/1 |
| 6,261,028 | B1 | 7/2001 | Volpe et al. | 405/210 |
| 6,662,416 | B1 | 12/2003 | Huggins | 27/1 |
| 6,665,916 | B1 | 12/2003 | Santorello et al. | 27/1 |
| 6,854,165 | B1 | 2/2005 | Parker | 27/1 |
| 7,024,735 | B1 | 4/2006 | Huggins | 27/1 |
| 7,117,570 | B1 * | 10/2006 | Borgerding | 27/1 |
| 7,127,783 | B1 | 10/2006 | Poole, Jr. et al. | 27/1 |
| 7,165,297 | B2 | 1/2007 | Poole, Jr. et al. | 27/1 |
| 7,272,874 | B2 | 9/2007 | Staab | 27/1 |
| 7,373,702 | B1 | 5/2008 | Vonderheide | 27/1 |
| 7,634,843 | B1 | 12/2009 | Michnuk | 27/1 |
| 8,074,328 | B2 | 12/2011 | Roberts | 27/1 |
| 2005/0144821 | A1 * | 7/2005 | Griesemer et al. | 40/546 |

* cited by examiner

*Primary Examiner* — William Miller
(74) *Attorney, Agent, or Firm* — Jonathan A. Bay

(57) ABSTRACT

A decorative memorial serves to display a sealed, visible portion of cremation ashes.

18 Claims, 9 Drawing Sheets

UNDERWATER, PET ASHES MEMORIAL DISPLAY AND MARINE REFUGE

CROSS-REFERENCE TO PROVISIONAL APPLICATION(S)

This application claims the benefit of U.S. Provisional Application No. 61/444,991, filed Feb. 21, 2011, the disclosure of which is incorporated herein in full by this reference thereto.

BACKGROUND AND SUMMARY OF THE INVENTION

The invention relates to a memorial for cremation ashes and, more particularly, to a memorial which predominantly serves as an underwater, pet ashes memorial display, but also importantly serves as a marine refuge.

It is popular to commit crematory ashes to the sea. However, there are many who find it unappealing simply to scatter the ashes of their beloved one into the sea. Others do not want to sink their beloved one's ashes in a crematory urn because, among other reasons, the urn will likely be at the mercy of sea currents, and be opened or dashed apart, or else very likely lost.

Artificial reefs do contribute to life in the sea. But mixing ashes with cement to make concrete blocks is appalling to quite a few. Other memorials do contain the ashes in containers, albeit in opaque containers such that the ashes cannot "see" out and the returning pet owner cannot see in.

It is an object of the invention to provide the memorializing pet owner with appealing and gratifying aspects in a memorial which the prior art lacks.

It therefore is an object of the invention to provide a memorial which predominantly serves as an underwater, ash "display," but which also importantly serves as a marine refuge.

It is an alternate object of the invention to gratify the memorializing parties with the satisfaction that their beloved pet's ashes can "see" light, even "see" sea life take root and thrive around the memorial.

It is an additional object of the invention to gratify the memorializing parties with the satisfaction that they can return and see their beloved ones ashes.

It is a further object of the invention to gratify the memorializing parties with the pleasure of returning to see their beloved ones ashes and discovering surprise sea creatures taking refuge in and around the memorial.

It is another object of the invention to gratify the memorializing parties with the satisfaction that their memorial is serving as refuge/reef for sea life.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

FIGS. 1-6 and 10-13 show alternative embodiments of a memorial 20 in accordance with the invention. The memorial 20 predominantly serves as underwater, crematory ash display 22. But it also importantly serves as a marine refuge and/or artificial reef. That is, this memorial 20 is also an underwater structure which invites and safely harbors sea animals with a den 30, and provides surfaces which attract and grow coral and plant life.

Figure 1:
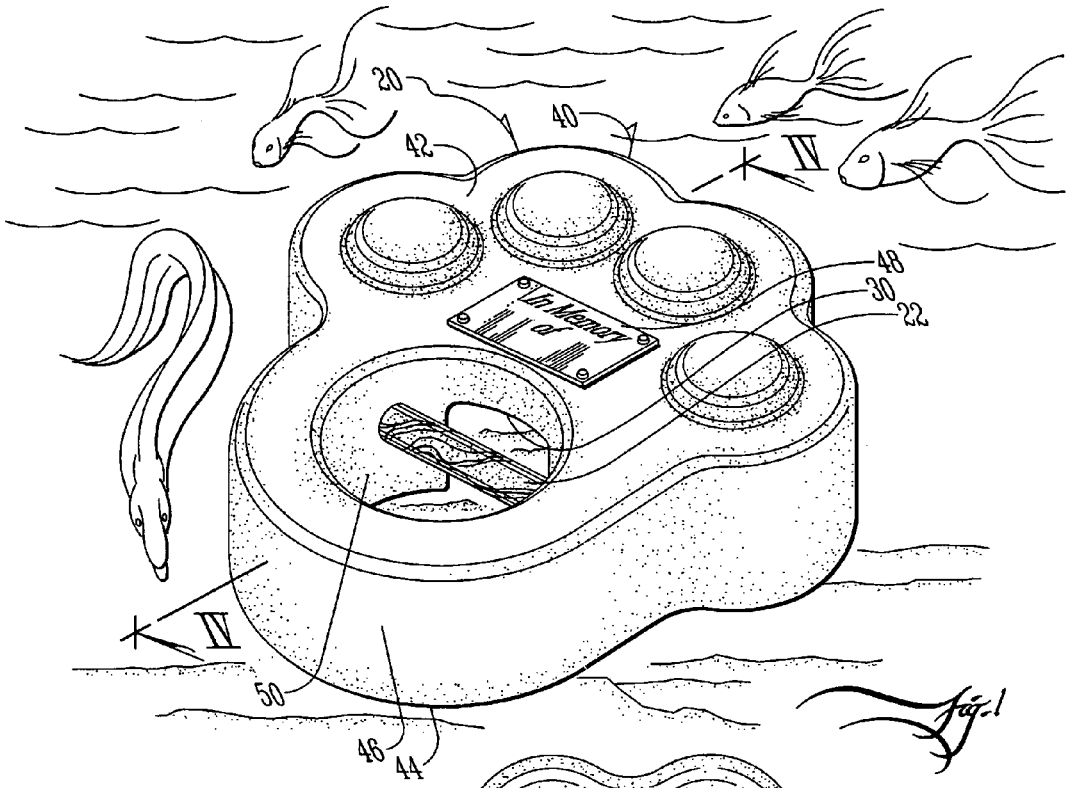
FIG. 1 is a perspective view of a memorial in accordance with the invention which predominantly serves as an underwater, pet ashes memorial display, but also importantly serves as a marine refuge.
Figure 2:
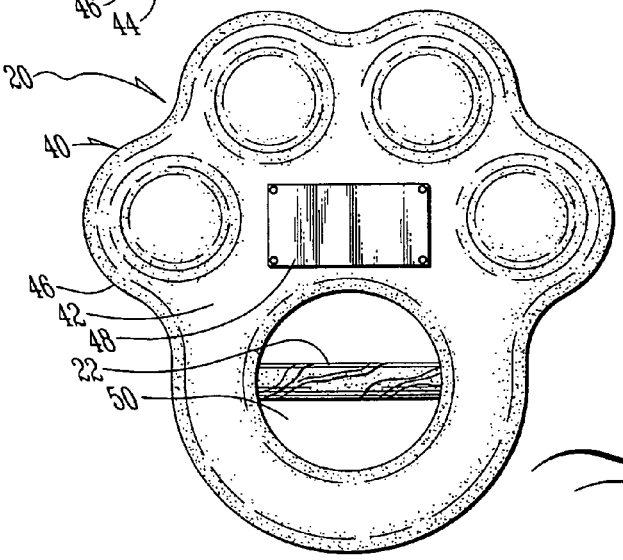
FIG. 2 is a top plan view thereof.
Figure 3:
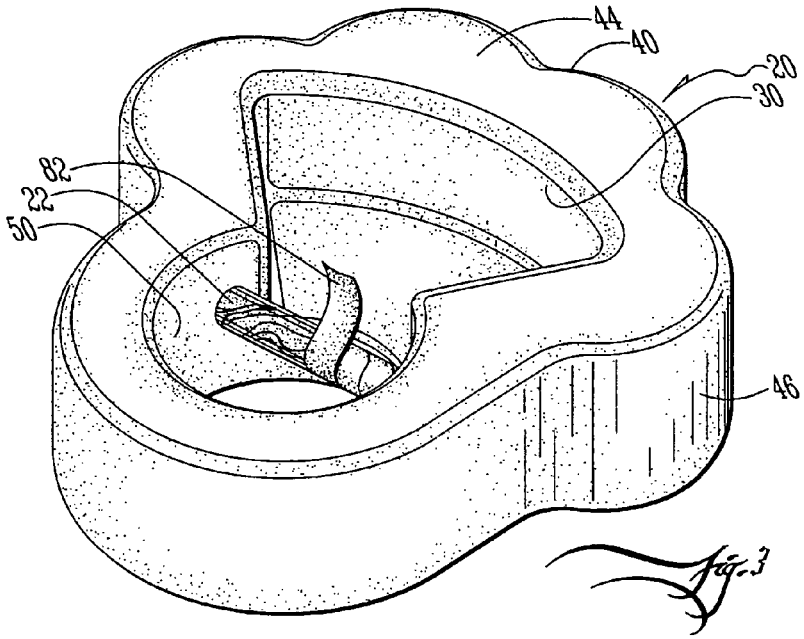
FIG. 3 is a perspective view of the memorial flipped upside down, and showing a protective liner around a transparent ash capsule to protect from scratches (at least during manufacture of the memorial, and possibly as well until final placement thereof)
Figure 10:
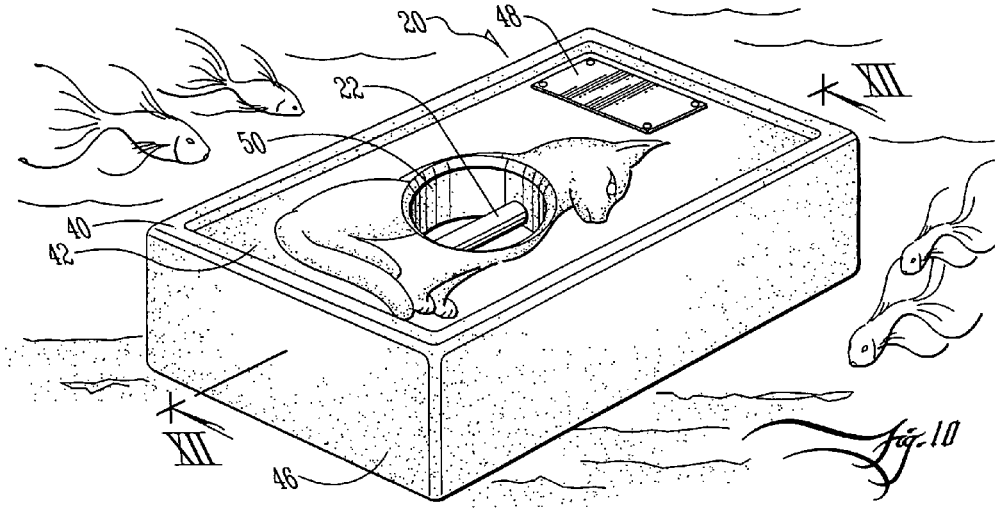
FIG. 10 is a perspective view comparable to FIG. 1 except of an alternative embodiment of the memorial in accordance with the invention.

The memorial 20 comprises a monument structure (ie., memorial body 40). It is a design preference that the body 40 is given a shape which simulates something with a pet theme. FIG. 1 shows the shape of a paw print. FIG. 10 shows the raised relief of a cat. The monument has a main decorated side 42, a back side 44, and a peripheral edge 46. FIGS. 1 and 2 show the main decorated side 42 of the paw print, and its outline and surface relief cooperatively simulate a paw print. The main decorated side 42 can carry a name plate 48 or the like. FIG. 3 shows the backside 44. The backside 44 is formed with a cavity that functions as a den 30 or, that is, as the sea creature marine refuge. The figures also show that the body 40 is formed with a window 50 that provides passage for sea creatures from the main decorated side 42 to the den 30 in the back side 44.

Preferably the body 40 is cast from cast materials such as and without limitation cement, mortar, plaster, glass, ceramics, metals, plastics, fiberglass and so on. However, the body 40 can also be formed or ground from any of the above as well as formed or ground from stone.

It is site location which predominantly determines whether the memorial 20 will be placed with its backside 44 on the bed of the sea floor, or else stood erect like a headstone. The determining factor is the risk that the memorial, if stood upright, will get blown down. It is believed that the memorial 20 will always be at high risk at being blown down if stood out in the open. Therefore, in the majority of site locations, the memorial 20 is laid flat with the back side 44 down. However, in special circumstances where there is a suitable cave or sea wall to protect the upright monument from currents and/or other impacts, the memorial 20 might be stood upright.

But again, in the majority of times, it is assumed that the memorial 20 will be most stable and enduring if laid flat, with the back side 44 down and the main decorated side 42 up.

It is undesirable that the memorial, if stood upright, topple over. The ash display or capsule 22 therefor might break, releasing the ashes or otherwise despoiling the brilliant whiteness thereof.

Figure 4:
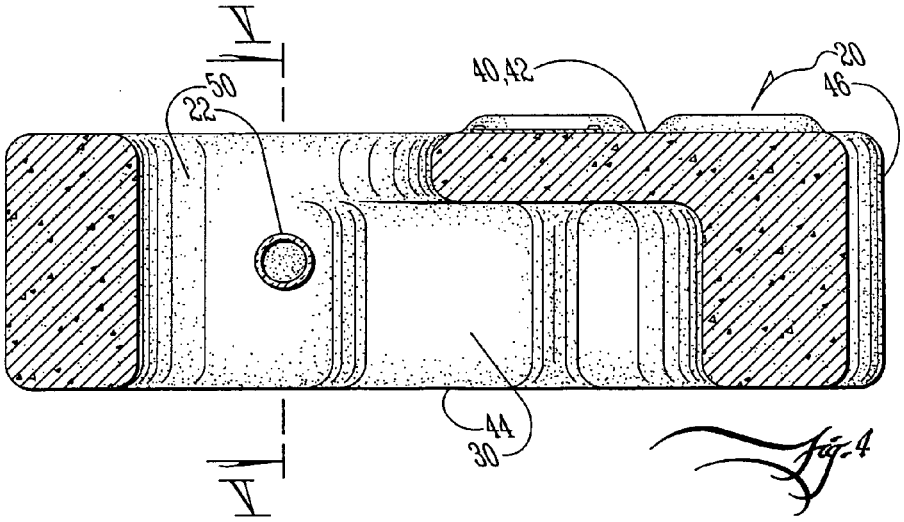
FIG. 4 is a vertical, longitudinal sectional view taken through FIG. 1.
Figure 5:
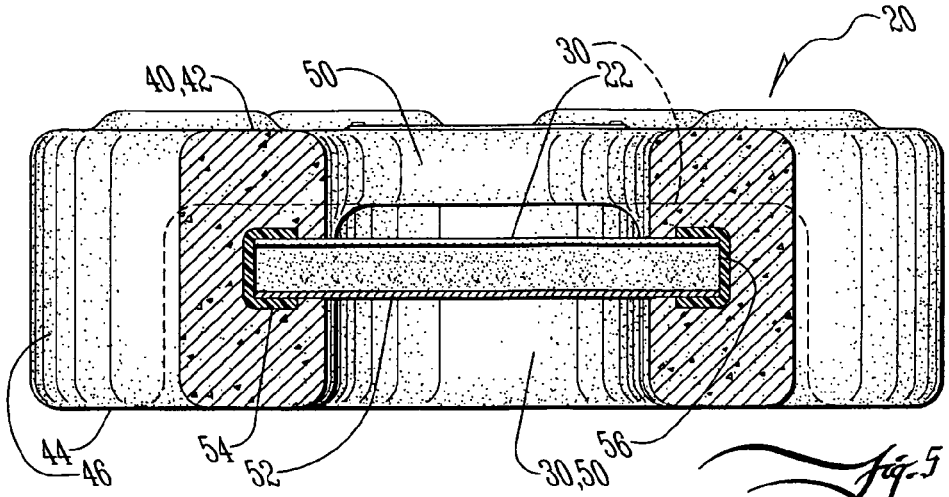
FIG. 5 is an enlarged-scale section view taken along line V-V of FIG. 4.

The window 50 forms a cylindrical passage from the main decorated side 42 to the cavity 30 in the back side 44. When the memorial 20 is laid with the back side 44 flat against the sea floor, the cavity forms an enclosed den 30. FIGS. 4 and 5 provide a pair of section views at right angles to each other to show in part a preferred shape for the den 30. FIG. 3 probably shows better the overall fan shape of the den 30. Again, the window 50 provides a cylindrical tunnel between the main decorated side 42 and the den 30 in the back side 44.

FIG. 5 shows better that an ash capsule 22 is preferably embedded in the matrix of the body 40. This is preferably accomplished by casting the capsule 22 in place as shown when the body 40 is made by a casting process.

For those unfamiliar with crematory ashes, it is a striking aspect of crematory ashes that they are particularly brilliantly pure white. It is an aspect of the invention to contain crematory ashes of a beloved one in a transparent (or if not, at least translucent) capsule 22 in accordance with the invention. When contained in such a transparent capsule 22, the ashes and capsule 22 appear almost to radiate light by virtue of being so white, so highly reflective.

It is an aspect of the invention to preserve at least a portion of a beloved one's crematory ashes in a transparent to translucent capsule 22. It is a further aspect of the invention to permanently seal the display 22 so that it is water tight and relatively pressure-proof.

It is another particular aspect of the invention to mount the display 22 in the memorial 20 (and thereafter carefully place the memorial) so that the ashes "see" light. Given the foregoing, it is preferred to place the memorial 20 as stably as possible for a number of reasons. For one, it is preferred if the memorial 20 is as permanently placed as possible. That way, the memorializing parties can be certain of the view for the capsule 22, and the viewing of the capsule 22. For another reason, it would be a catastrophic disaster if the memorial 20 fell and broke or breached the capsule 22. Hence, setting the memorial 20 flat on the bed of the sea floor is a safe placement for the memorial 20.

Preferably the ash display 22 comprises a transparent tube 52 sealed by end caps 54 or plugs (end caps 54 shown). The display 22 can be produced of tempered glass, or else tough plastic materials which will withstand the chemical attack of sea water over time. The end caps 54 or plugs can be mechanically fastened in place (eg., screwed in place), glued in place, or and any combinations thereof (glued in place is shown).

Figure 6:
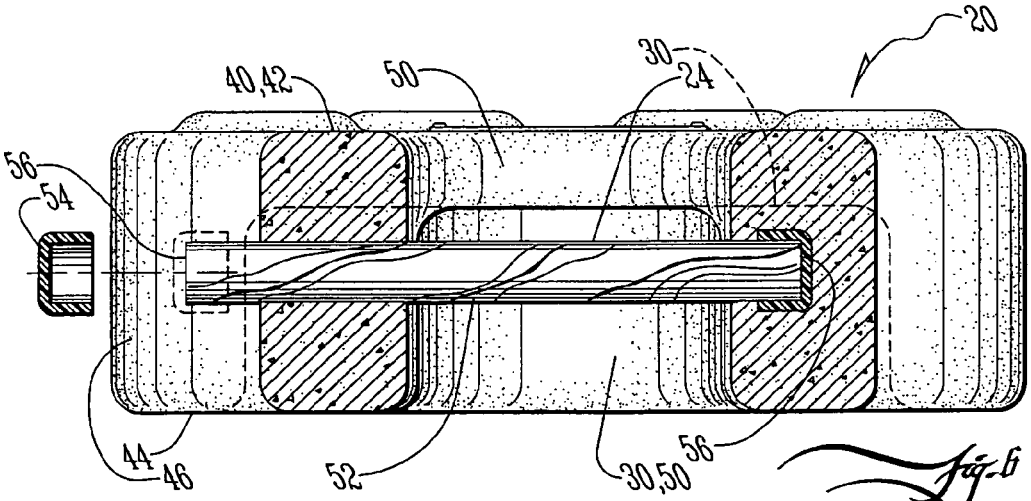
FIG. 6 is a sectional view comparable to FIG. 5 except showing an alternate embodiment of the ash capsule.

FIG. 6 shows a concession for international export of the memorial 20 in accordance with the invention. For transit, the capsule 24 of FIG. 6 must be accessible, in order the customs/border agents can inspect the contents for illicit materials. Hence, the FIG. 6 embodiment shows the capsule 24 with one end 54 protruding out of the peripheral edge 46 of the body 40. The end cap 54 (or plug) is left free for the end-user to get access to the interior of the capsule 24. That way, the end-user can partially fill the capsule 24 with crematory ashes, and then permanently seal the capsule 24.

It is an additional aspect of the invention that the capsule 22 is mounted in the body 40 such that the capsule 22 is centered in the window 50, or at least forms a portion of the wall of the window 50. That is, it is a design preference that the ashes "see" light through the window 50. It is a further design preference that the ashes can be prominently seen showcased at or near the center of the window 50. It is still a further design preference that the capsule 22 be the equivalent of a "rung" on a ladder for sea creatures to step and/or slither across when entering and exiting the den 30.

Alternatively, the capsule 22 might be given an alternative shape so that it is personalized for a particular use or significance. For example, the capsule 22 might be given a heart shape.

Figure 7:
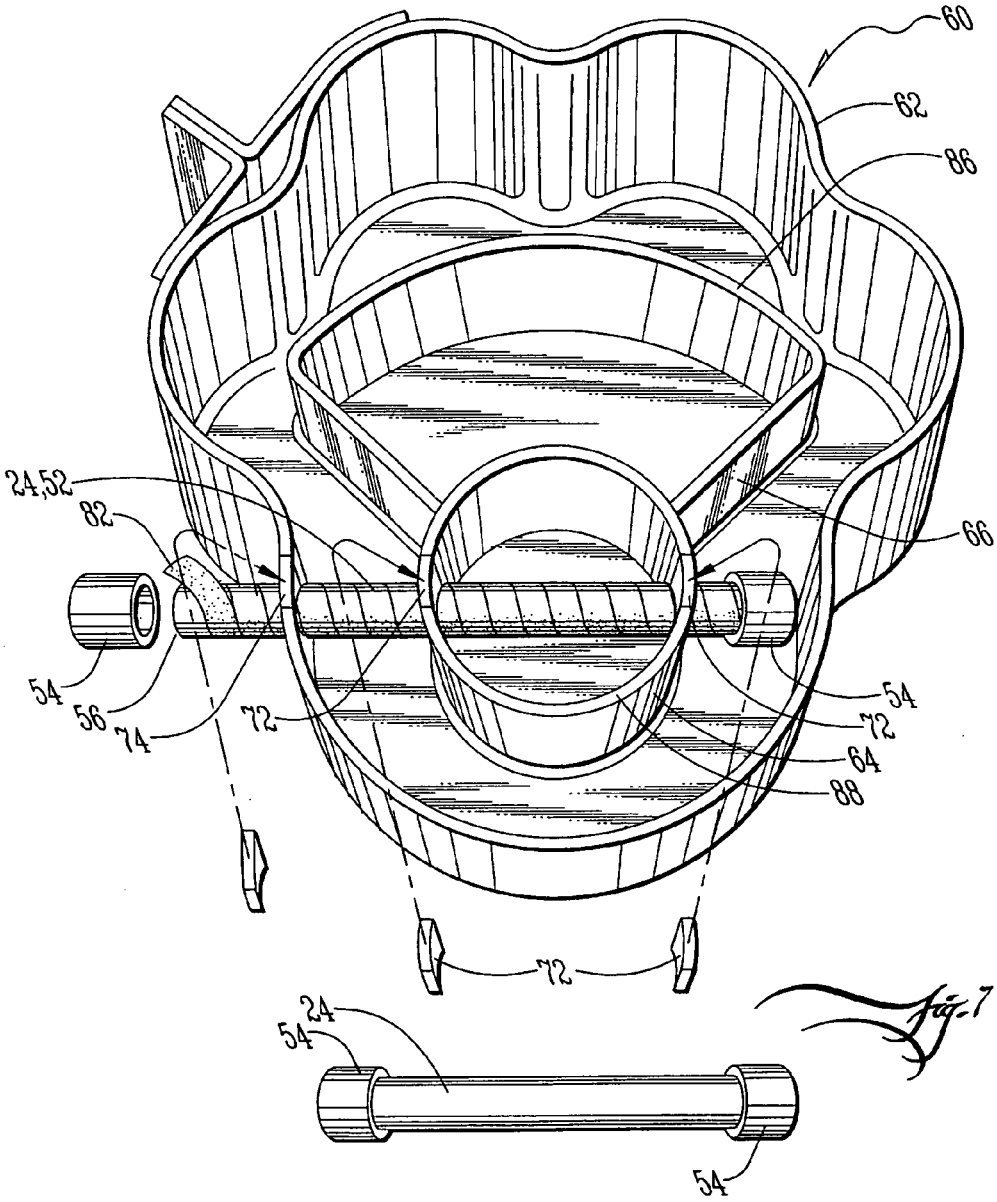
FIG. 7 is a perspective view of a mold for casting the memorial in accordance with the invention.
Figure 8:
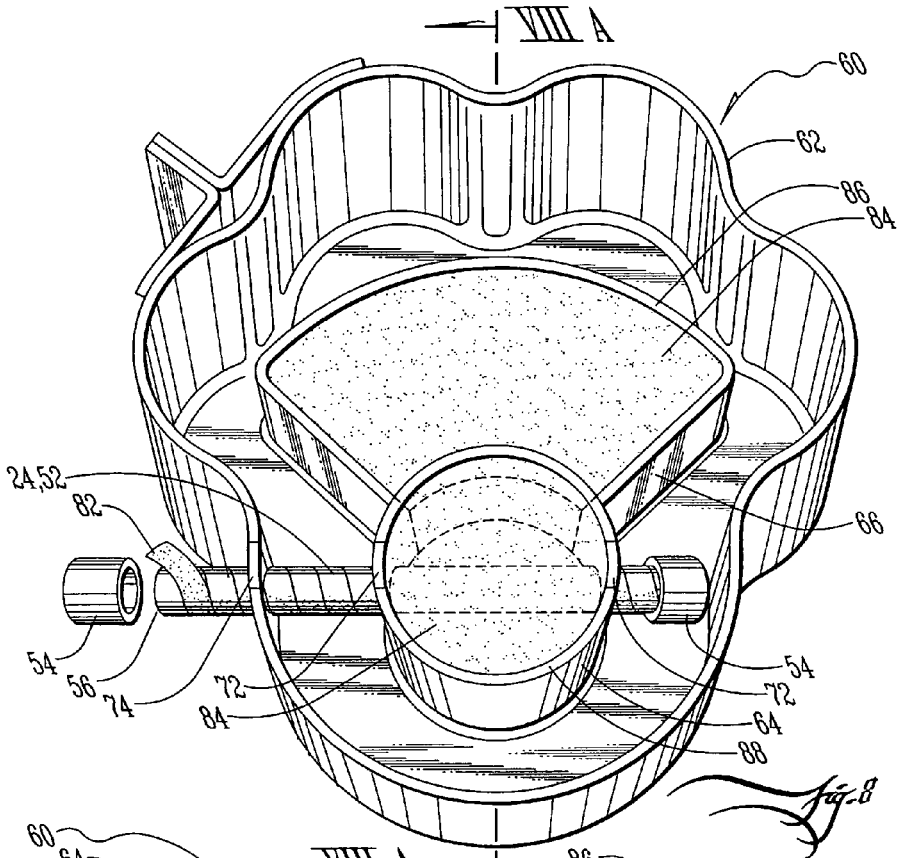
FIG. 8 is a perspective view comparable to FIG. 7 except showing a step in the method of making the memorial in accordance with the invention.
Figure 9:
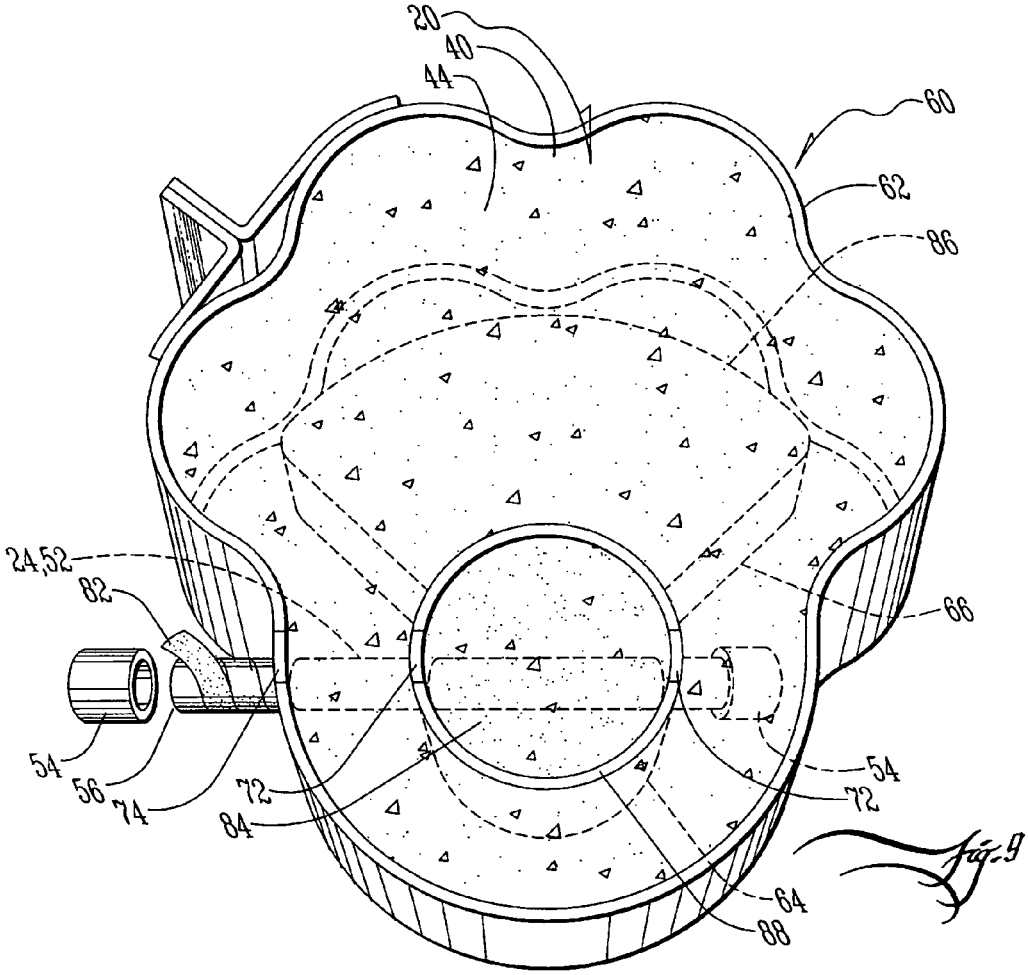
FIG. 9 is a perspective view comparable to FIGS. 7 and 8 except showing the casting material cast into the mold.

FIGS. 7 through 9 show a preferred manner of making the body 40, including casting the body 40. FIG. 7 shows a mold 60 for casting the body 40. The body 40 is cast with back side 44 down, and the main design side 42 up.

The mold 60 is made of formed sheet metal sections. The sheet metal provides a circumference 62 which simulates a paw outline. Preferably the outline 62 of the sheet metal is tweaked and modified before each re-use to render unique outlines distinct from every other. The sheet metal sections are attached to each other by pop rivets, and screwed to base such as plywood or the like. Placed wholly within the periphery of the paw outline 62 are a pair of sleeves 64 and 66. One sleeve 64 forms the window 50, the other sleeve 66 forms the den 30.

The sleeve 64 that forms the window 50 has two cut-outs 72 that allow the lifting of the mold 60 off the cast body 40 and past the capsule 22 after the casting 40 has hardened. The sheet metal of the paw outline 62 also has one such cutout 74 for the same purpose if the embodiment of FIG. 6 is intended to be cast.

As FIGS. 3 and 7 show, the ash capsule 22 if preferably protected in a protective liner 82 in order to protect its finish from scratches during the pour of the casting material. A wrap of masking tape 82 will suffice. The wrap 82 just might be left on the capsule 22 until the final underwater placement of the memorial 20. If the FIG. 5 embodiment is to be cast, then the capsule 22 is made up in advance, filled or at least partly filled with ashes, and then sealed. If the FIG. 6 embodiment is to be cast, then only the one end 54 of the capsule 24 that will be permanently embedded in the matrix of the body 40 has to be sealed in advance. The other end 54 has to be left unsealed. Albeit, it might be removably capped and/or plugged until ultimately delivered to the end-user so that it does not collect unwanted debris. Preferably sealant is applied around all cracks in the sheet metal edges of mold 60 to ensure clean lines on the pour.

Figure 8A:
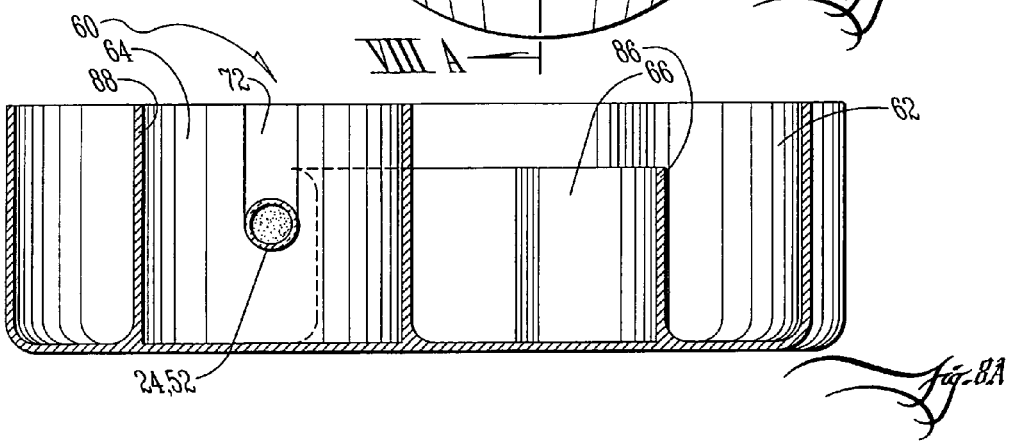
FIG. 8A is a vertical, longitudinal sectional view taken along line VIIIA-VIIIA of FIG. 8.

FIG. 8A is a vertical, longitudinal sectional view taken along line VIIIA-VIIIA of FIG. 8, but it does not show FIG. 8. It shows FIG. 7. As yet, sand 84 has not been added to the two inner sleeves 64 and 66.

FIG. 8 shows that sand 84 has been added to the two inner sleeves 64 and 66. The inner sleeve 66 which forms the den 30 has been filled to its brim 86. However, that is about three-fourths the height of the outer wall 62 which forms the paw-print outline. The inner sleeve 64 which forms the window 50 is indeed the same height as the outer wall 62. Hence the inner sleeve 64 for the window 50 will form an aperture in the body 40, while the inner sleeve 66 for the den 30 will form a cavity.

There are any number of suitable casting materials, but cementitious materials including mortar based materials are preferred. FIG. 9 shows that a mortar mixture has been poured into the mold 60 to the common elevation of the brim of the outer wall and the brim 88 of the sleeve 64 which forms the window 50. This is the main decorated side 42 of the body 40. Additional surface treatments can be given to this side 42 as desired. The toe pad imprints can be impressed into the flat surface, and so on. Further embellishments might include sinking brass hooks into the main decorated side 42 and allowing them to cure into the matrix of the cast body 40. After the body 40 hardens, the brass hooks allow for the mounting of a name plate 48 or the like.

Further embellishments might include casting lifting rings (none shown) into either of the peripheral edge 46 of the outline 62, or the back side 44. Given the preferred size of the memorial 20, it is heavy. A preferred size of the paw print memorial 20 is nominally about eighteen inches in diameter (~45 cm) and six inches thick (~15 cm). This still yields a seventy pound (~30 kg) memorial 20. The memorial 20 might be hoisted by such a lifting ring. Underwater, the memorial 20 is transported manually by scuba divers through use of inflated balloons. It is a technique inspired by how underwater archaeologists lift salvage.

For the FIG. 5 embodiment of the invention, preferably the capsule 22 is about eight inches long (~20 cm) and one inch in outside diameter (2.54 cm).

FIGS. 10-13 show an alternative embodiment of the memorial 20 in accordance with the invention, one which has a regular outline (eg., a rectangular outline), but one wherein more of the decorative aspects of the decorated side 42 are obtained through surface relief. In this instance, the design side 42 simulates the relief of a sitting cat.

Figure 11:
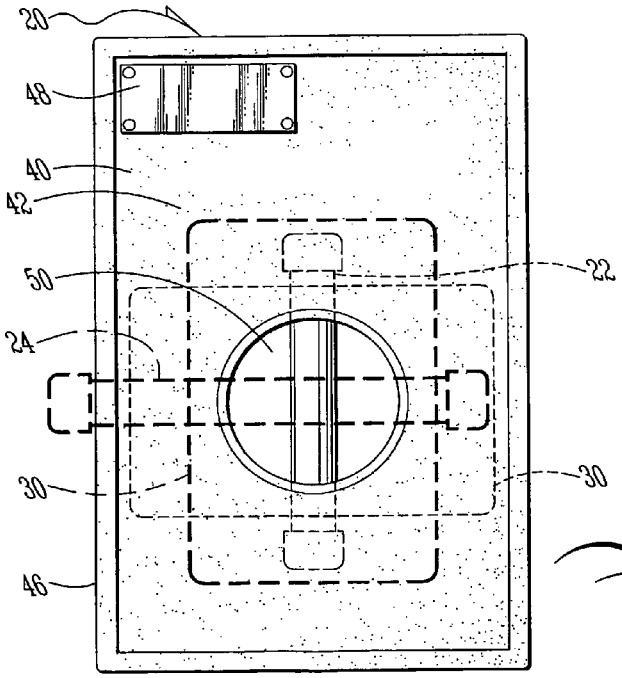
FIG. 11 is a top plan view thereof.
Figure 12:
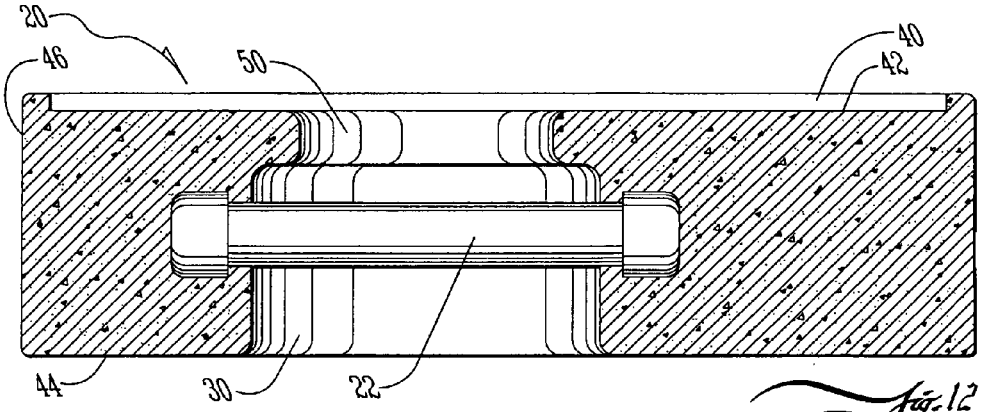
FIG. 12 is an enlarged-scale section view taken along line XII-XII in FIG. 10.
Figure 13:
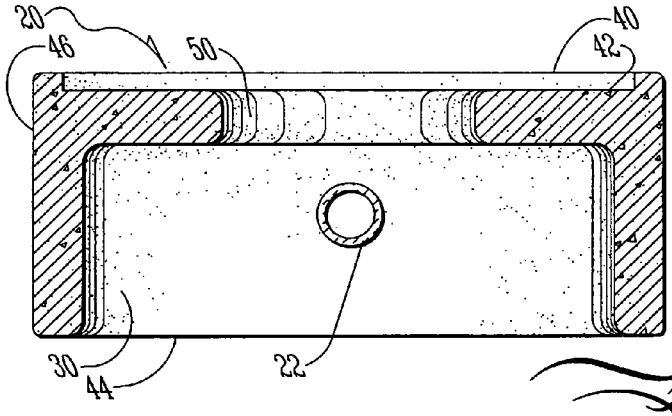
FIG. 13 is a vertical, lateral section view therethrough.

FIG. 11 shows that the den 30 is preferably rectangular too. The den 30 can be oriented with long sides parallel to the long sides of the body 40, or perpendicular to the long sides of the body 40. It is preferred that the ash capsule 22 is oriented to cut across the window 50 oriented between the short sides of the den 30. This is just a slight design preference because if crumpled up chicken wire is going to be cast into the matrix of the body 40, it gives the chicken wire more holding power on the ash capsule 22, and overall more strength to the casting 40.

However, the shapes of the window 50 and den 30 are arbitrary and are fully changeable at the choice of the designer, who might be imagining an inviting window 50 and den 30 for a particular sea creature species. Just like house martin and bluebird boxes are sensitive to hole diameter, the window 50 shape and ash capsule 22 orientation might favor one species over another.

This memorial 20 suits in particular someone like the inventor, who wants to create a lasting memorial 20 with holes and crevices centered around the visible cremation ashes. These holes and crevices serve as safe refuges for marine animals. Also, the surfaces of the memorial 20 are chosen to be conducive to invite sea plants and coral to take root and/or attach.

As mentioned above, for those unfamiliar with crematory ashes, it is a striking aspect of crematory ashes that they are particularly brilliantly pure white. When contained in a transparent capsule 22, the ashes/capsule 22 appear almost to radiate light by the nature of being so highly reflective.

To put it differently, the ashes and capsule 22 seem to glow with their own internal energy. In part this might be due to an optical effect where, the den 30 is inky black, and provides a stark contrast to the highly reflective ash and capsule 22 combination.

Regardless, sea life is truly nurtured around the bright center ashes of the memorial 20. Having a portion of the ashes visible, yet protected, in the opening 50 where sea animals will enter and seek refuge provides comfort and satisfaction to the memorializing pet owner that her (or his) memorial 20 will truly become part of the protection of the underwater sea world. Parties who will want to memorialize their beloved one with this memorial 20 will envision that eel, fish, lobster or crab will pass by their beloved one's ashes regularly and often while entering and exiting the safe harbor of the den 30.

As any experienced scuba diver can relate, a truly enjoyable activity is exploring nooks and caves for eels, lobster, crab, octopus and so on. These kinds of sea creatures are typically found in protected holes within the coral (but just as often within shipwrecks or other man-made debris). Memorializing parties can add to this colorful, wonderful underworld by placing a memorial 20 in accordance with the invention where a moray eel or an octopus will pass by the ashes to explore the hole 50 and the den 30. The thought of providing such a refuge to sea life provides content satisfaction to memorializing parties that their memorial 20 is the most fitting memorial 20. It is such a memorial 20 that allows the ashes to "see" light and "feel" the brush of sea creatures entering and sheltering in the safe retreat. The foregoing is what makes memorializing parties feel like they have committed their beloved pet to at last become one with and part of the living ocean. The memorializing parties can believe that their beloved one can "see" the bedazzling light and "feel" the brush of persisting life.

Figure 14:
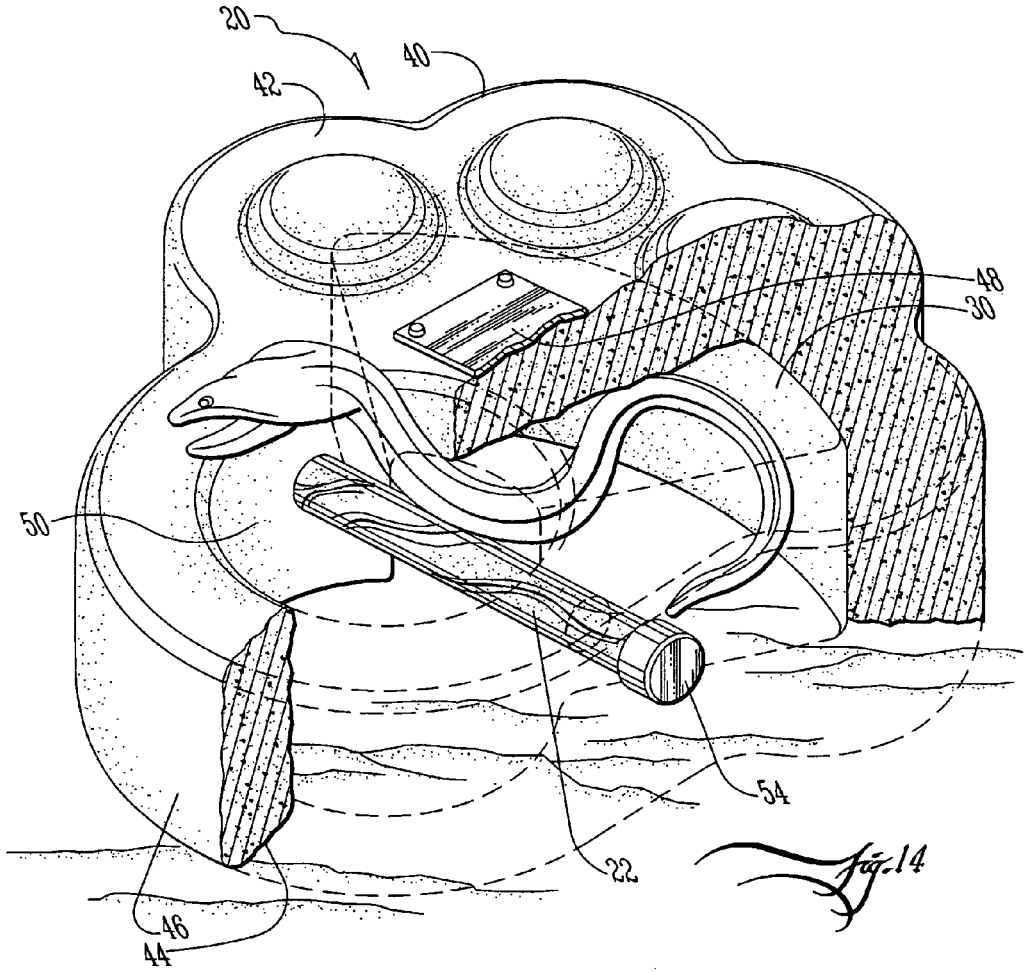
FIG. 14 is a perspective view comparable to FIG. 1, except showing more particularly how the memorial also serves as a marine refuge.

As said before, it is a design preference of the invention that the capsule 22 is mounted at or near the center of the window 50, in part so that the ashes get clear "view" of the overhead light, and so that the ashes can be clearly seen by scuba divers hovering above. However, it is yet an additional design preference of the invention that the capsule 22 sort of serves as the equivalent of a "rung" on a ladder, so that sea creatures step on and/or slither across when entering and exiting the den 30. And FIG. 14 shows how the memorializing owner of the memorial 20 hopes to be greeted someday.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A memorial for containing and displaying cremation ash, the memorial comprising:

a body having a peripheral wall defining a body in exterior as well as defining a cavity that opens to the body exterior and forms a window therefor;

a cremation ash capsule for containing the cremation ash and having a peripheral wall defining a hollow interior which is open to an exterior of the memorial, the cremation ash capsule being provided with at least one hole in the peripheral wall thereof which communicates with the hollow interior;

the body being provided with at least one hole in the peripheral wall thereof which communicates with the cavity; and wherein the cremation ash capsule is inserted through the at least one hole of the body and such that a portion of the cremation ash capsule extends within the cavity of the body and the portion is thus seen from the window from most vantage points exterior of the memorial for displaying the cremation ash.

2. The memorial of claim 1 further comprising a name plate, personal memorial tag, etching or inscription.

3. The memorial of claim 1 wherein the capsule is permanently affixed within the memorial.

4. The memorial of claim 1 wherein the cremation ash capsule is permanently sealed.

5. The memorial of claim 1 comprising a material resistant to water for placement underwater as one or both of a host and a support for one or both of animal and plant life.

6. The memorial of claim 5 for function in salt water environments.

7. The memorial of claim 5 comprising one or more of: limestone rock, concrete, natural cement, granite, sand and any combination thereof.

8. The memorial of claim 5 may be shaped as one of round, square, paw print, foot print, hand print, and with or without surface relief.

9. The memorial of claim 8 wherein the shape is indicative of a type of animal the memorial is memorializing.

10. The memorial of claim 1 wherein the body comprises a casting from a mold.

11. The memorial of claim 10 wherein the body comprises a casting of any of concrete, mortar, plaster, glass, ceramics, plastic or combinations thereof.

12. The memorial of claim 11 comprising a material which is slowly dissolvable in water.

13. A memorial for containing and displaying cremation ash; comprising:

an elongated cremation ash capsule having spaced ends and a peripheral wall extending therebetween defining a hollow interior for containing the cremation ash; and a body having a peripheral wall defining a body exterior as well as defining a cavity that opens to the body exterior, said body being formed with a pair of aligned holes across from each other in the cavity;

wherein the cremation ash capsule is supported to span across the cavity in the aligned holes across from each other in the cavity of the body such that a portion of the cremation ash capsule extends within the cavity of the body and said portion is thus seen from most vantage points exterior of the memorial for displaying the cremation ash.

14. The memorial of claim 13 wherein the body exterior comprises a main side, a back side and a peripheral edge.

15. The memorial of claim 14 wherein at least one end of the cremation ash capsule extends through body to protrude out the peripheral edge.

16. The memorial of claim 13 wherein at least one end of the cremation ash capsule is formed with a hole to the hollow interior and provided with a closure.

17. A memorial for containing and displaying cremation ash; comprising:

a cremation ash capsule having a peripheral wall defining a hollow interior for containing the cremation ash; and a body having a peripheral wall defining a body exterior comprising a a decorated front side (42), a back side (44) and a peripheral edge (46), said body defining a den (30) serving as a refuge for sea creatures and a communicating relatively smaller window (50) in the decorated front side (42) allowing sea creatures passage in and out of the body through the front side (42) thereof;

wherein the cremation ash capsule is supported in the window (50) of the body such that a portion of the cremation ash capsule is thus seen from most vantage points exterior of the decorated front side (42) of the body of the memorial for displaying the cremation ash.

18. The memorial of claim 17 wherein the peripheral wall of the cremation ash capsule comprises a transparent material.

* * * * *